US006492780B1

(12) United States Patent
Sheu et al.

(10) Patent No.: US 6,492,780 B1
(45) Date of Patent: Dec. 10, 2002

(54) LAMP BALLAST SYSTEM

(75) Inventors: Tyng-Jeng Sheu, Kaohsiung Hsien (TW); Chia-Ming Hsu, Kaohsiung Hsien (TW)

(73) Assignee: Andertion Shang Industrial Co., Ltd., Kaosiung (TW)

( * ) Notice: Subject to any disclaimer, the term of this patent is extended or adjusted under 35 U.S.C. 154(b) by 0 days.

(21) Appl. No.: 09/923,174

(22) Filed: Aug. 6, 2001

(51) Int. Cl.[7] ..... H05B 37/02
(52) U.S. Cl. ..... 315/219; 315/224; 315/276
(58) Field of Search ..... 315/224, 219, 315/276, 277

(56) References Cited

U.S. PATENT DOCUMENTS 5,416,386 A * 5/1995 Nilssen ..... 315/209 R

* cited by examiner

*Primary Examiner*—David Vu

(74) *Attorney, Agent, or Firm*—Harness, Dickey & Pierce, P.L.C.

(57) ABSTRACT

A lamp ballast system includes a frequency inverter unit having a driver circuit connected to a voltage multiplying unit so as to receive a voltage-multiplied direct current output therefrom, an oscillator circuit connected to and driven by the driver circuit so as to generate a high-frequency oscillating current output, and a converter circuit connected to the oscillator circuit and operable so as to convert the oscillating current output into a stable high voltage, high frequency alternating current output. A phase correction unit interconnects the converter circuit and the lamp load, and includes at least one set of a transformer and a capacitor that are connected in series.

5 Claims, 4 Drawing Sheets

LAMP BALLAST SYSTEM

BACKGROUND OF THE INVENTION

1. Field of the Invention

The invention relates to a lamp ballast system that can provide a stable operating current to a lamp load.

2. Description of the Related Art

In a conventional lamp ballast system, the operating current that is provided to a lamp load generally fluctuates according to the characteristics of an alternating current (AC) power input. The fluctuation as such can lead to inefficient power consumption and in a shorter service life for the lamp load and electrical components of the lamp ballast system.

SUMMARY OF THE INVENTION

Therefore, the main object of the present invention is to provide a lamp ballast system that can supply a stable operating current to a lamp load even under the presence of input power fluctuations.

Another object of the present invention is to provide a lamp ballast system that can automatically cut-off current supply to the lamp load upon detection of load over-voltage conditions.

According to the present invention, a lamp ballast system is adapted to be connected to a lamp load, and comprises a rectifying and filtering unit, a voltage multiplying unit, a frequency inverter unit, and a phase correction unit. The rectifying and filtering unit is adapted to rectify and filter an alternating current input so as to generate a direct current output. The voltage multiplying unit is connected to the rectifying and filtering unit so as to receive the direct current output therefrom. The voltage multiplying unit is operable so as to generate a voltage-multiplied direct current output. The frequency inverter unit includes a driver circuit, an oscillator circuit, and a converter circuit. The driver circuit is connected to the voltage multiplying unit so as to receive the voltage-multiplied direct current output therefrom. The oscillator circuit is connected to and is driven by the driver circuit so as to generate a high-frequency oscillating current output. The converter circuit is connected to the oscillator circuit so as to receive the high-frequency oscillating current output. The converter circuit is operable so as to convert the oscillating current output Minot a stable high voltage, high frequency alternating current output. The phase correction unit is adapted to interconnect the converter circuit and the lamp load, and includes at least one set of a transformer and a capacitor that are connected in series.

Preferably, an over-voltage protection unit is connected to the phase correction unit, the voltage multiplying unit and the driver circuit. The over-voltage protection unit inhibits operation of the voltage multiplying unit and the driver circuit upon detection of an over-voltage condition at the phase correction unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
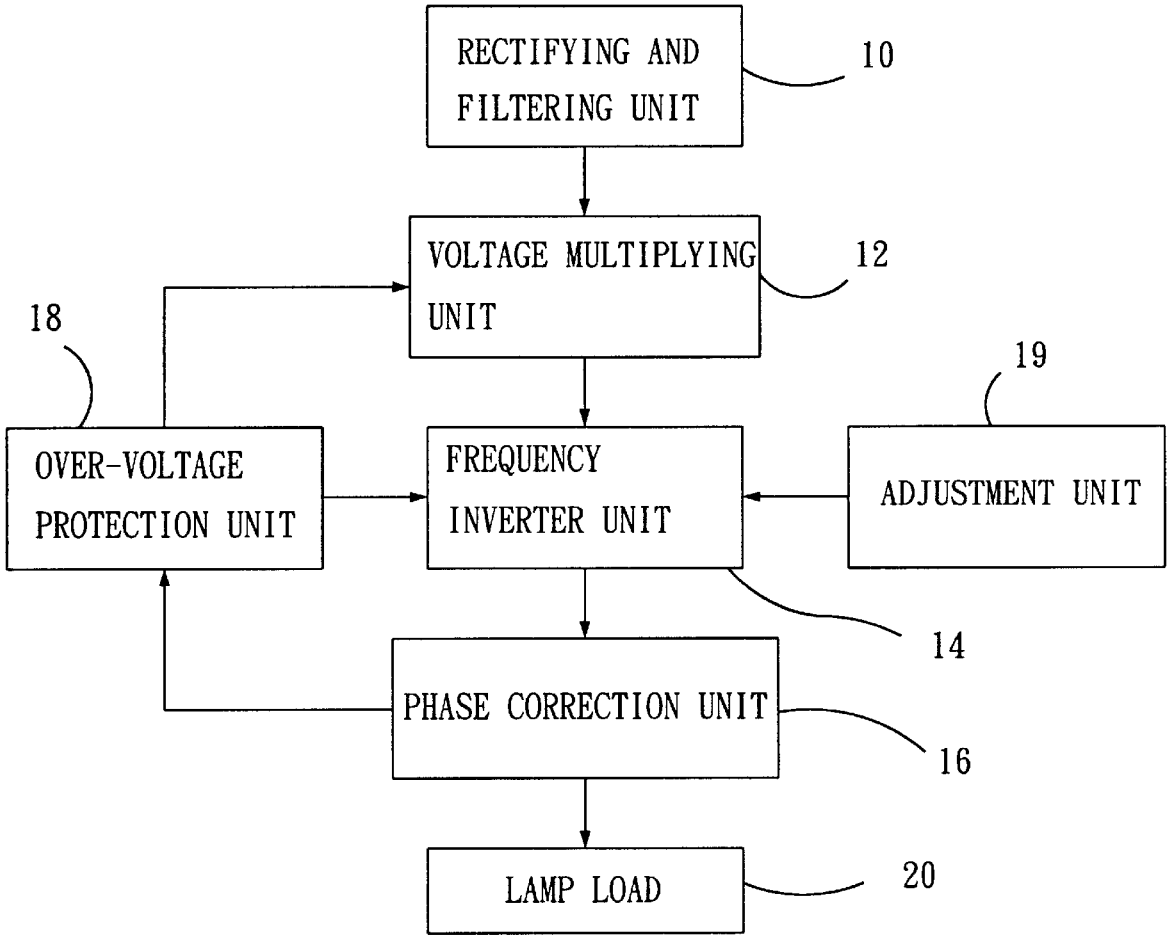
FIG. 1 is a schematic circuit block diagram showing the preferred embodiment of a lamp ballast system according to the present invention.

Referring to FIG. 1, the preferred embodiment of a lamp ballast system according to the present invention is shown to comprise a rectifying and filtering unit 10, a voltage multiplying unit 12, a frequency inverter unit 14, a phase correction unit 16, and an over-voltage protection unit 18.

Figure 2:
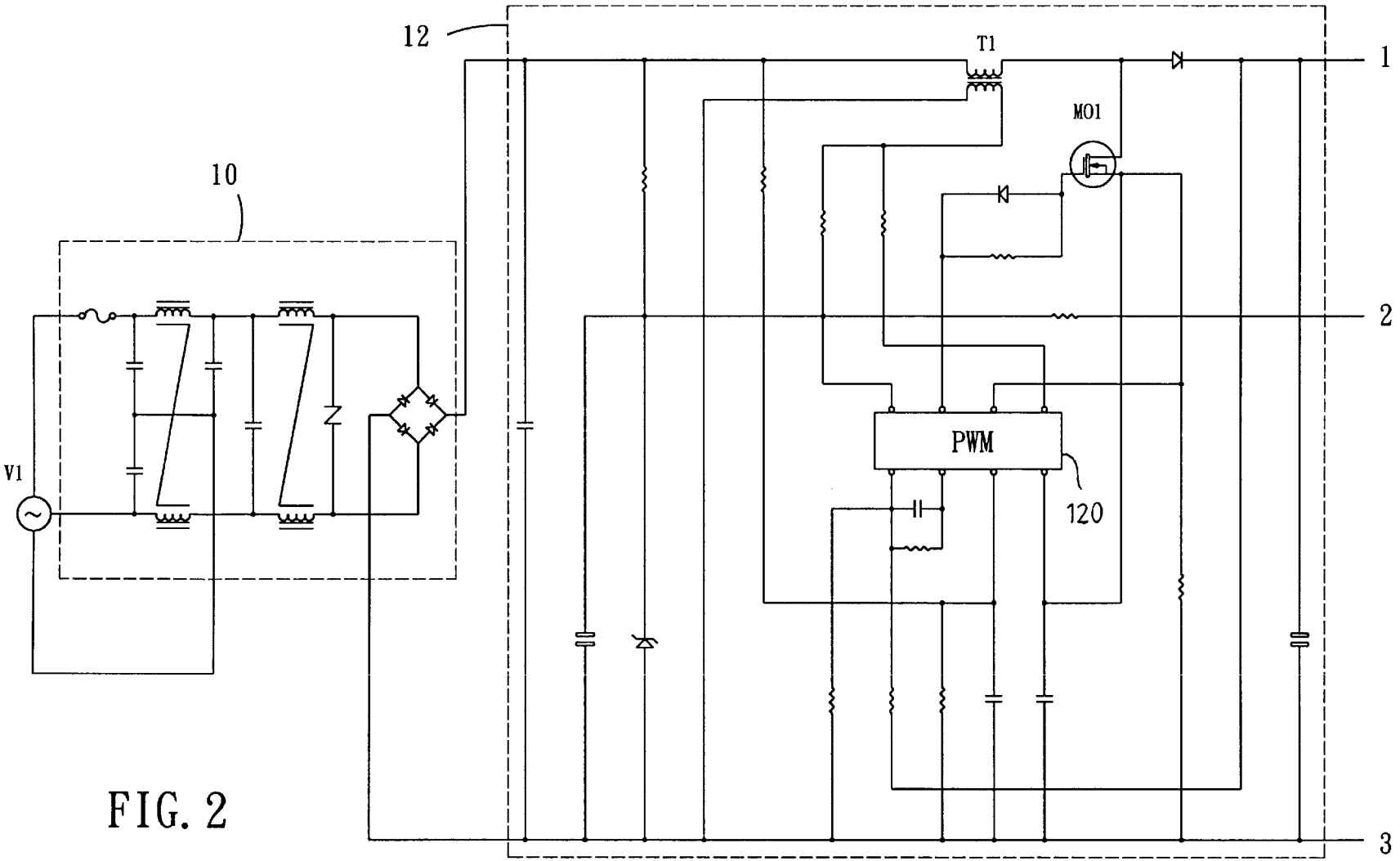
FIG. 2 is a schematic electrical circuit diagram showing a rectifying and filtering unit and a voltage multiplying unit of the preferred embodiment.

With further reference to FIG. 2, the rectifying and filtering unit 10 is adapted to rectify and filter a 110-volt or 220-volt alternating current (AC) input from an AC power source (V1) so as to generate a direct current (DC) output. The voltage multiplying unit 12 is connected to the rectifying and filtering unit 10, and receives the DC output from the rectifying and filtering unit 10. The voltage multiplying unit 12 includes a known arrangement of a pulse-width modulator 120, a transformer (T1) and a transistor (MO1), and operates so as to generate a voltage-multiplied DC output.

Figure 3:
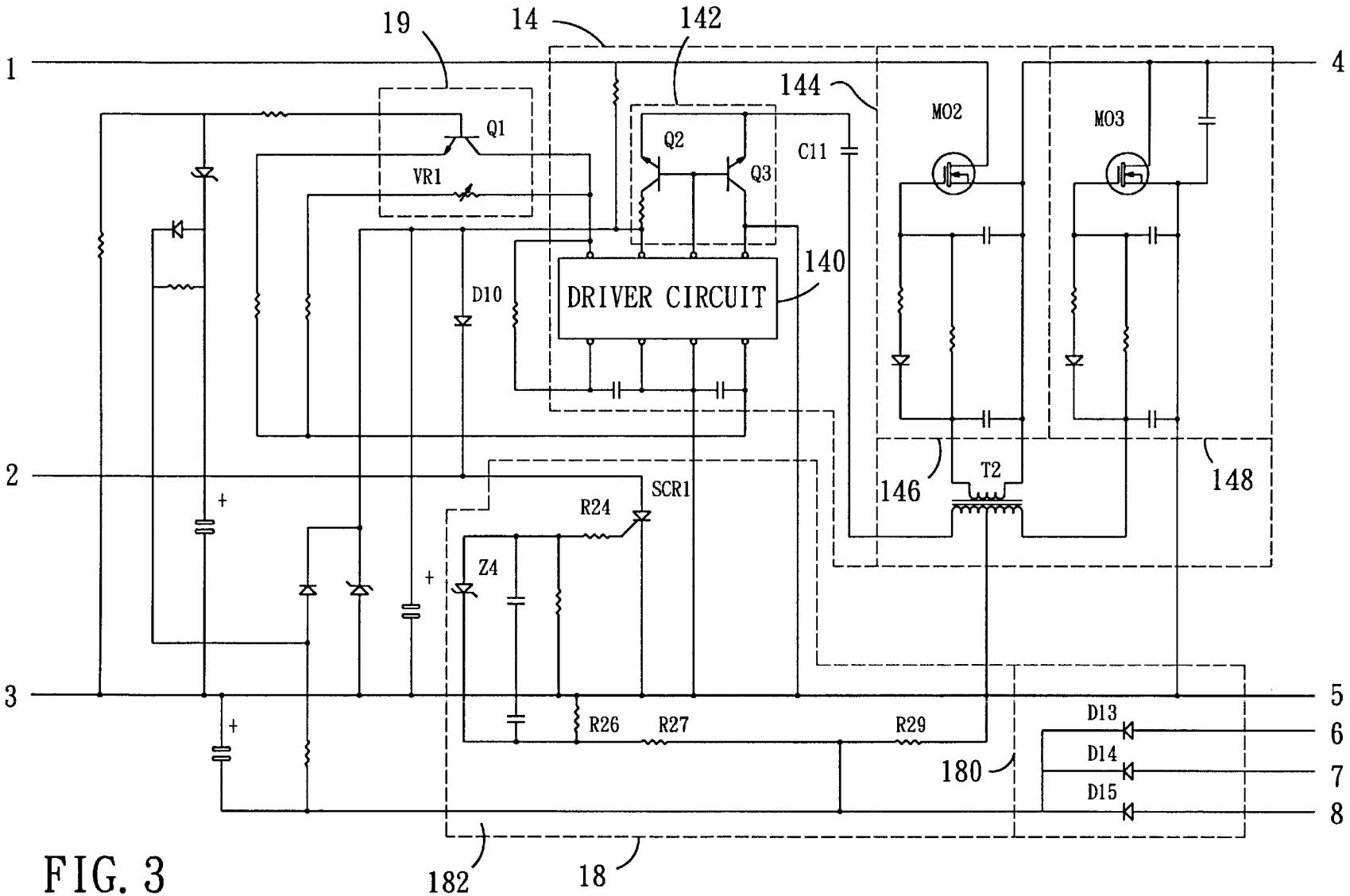
FIG. 3 is a schematic electrical circuit diagram showing a frequency inverter unit and an over-voltage protection unit of the preferred embodiment.

Referring to FIG. 3, the frequency inverter unit 14 is connected to the voltage multiplying unit 12 at node 1 so as to receive the voltage-multiplied DC output therefrom. The frequency inverter unit 14 includes a driver circuit 140, in the form of a pulse-width modulator, a push-pull oscillator circuit 142 connected to and driven by the driver circuit 140 so as to generate a high-frequency oscillating current output, and a converter circuit 144 connected to the push-pull oscillator circuit 142 so as to receive the oscillating current output therefrom. The converter circuit 144 is responsible for converting the oscillating current output into a stable high voltage, high frequency AC output. The voltage-multiplied DC output from the voltage multiplying unit 12 serves as an operating voltage for the driver circuit 140. Upon receipt of the voltage-multiplied DC output, the driver circuit 140 provides a pulse-width modulated output to the push-pull oscillator circuit 142. The push-pull oscillator circuit 142 includes a pair of transistors Q2, Q3 connected in parallel and further connected in series with a coupling capacitor C11. The pulse-width modulated output from the driver circuit 140 triggers the transistors Q2, Q3 to conduct alternately, thereby resulting in the high-frequency oscillating current output that is filtered by the coupling capacitor C11 to remove unwanted DC components and that is supplied to the converter circuit 144. The converter circuit 144 includes a step-up transformer T2 connected to the coupling capacitor C11, and a pair of half-wave switching transistor circuits 146, 148 connected in parallel to the transformer T2. Each of the switching transistor circuits 146, 148 is provided with a respective transistor MO2, MO3. The transformer T2 receives the oscillating current output via the coupling capacitor C11, and increases its voltage before providing the same to the switching transistor circuits 146, 148. The output of the transformer T2 is used to drive push-pull operation of the transistors MO2, MO3 of the switching transistor circuits 146, 148, thereby enabling the switching transistor circuits 146, 148 to generate sinusoidal half-wave cycles that are combined at an output node 4 of the converter circuit 144 to result in the stable high voltage, high frequency AC output.

Figure 4:
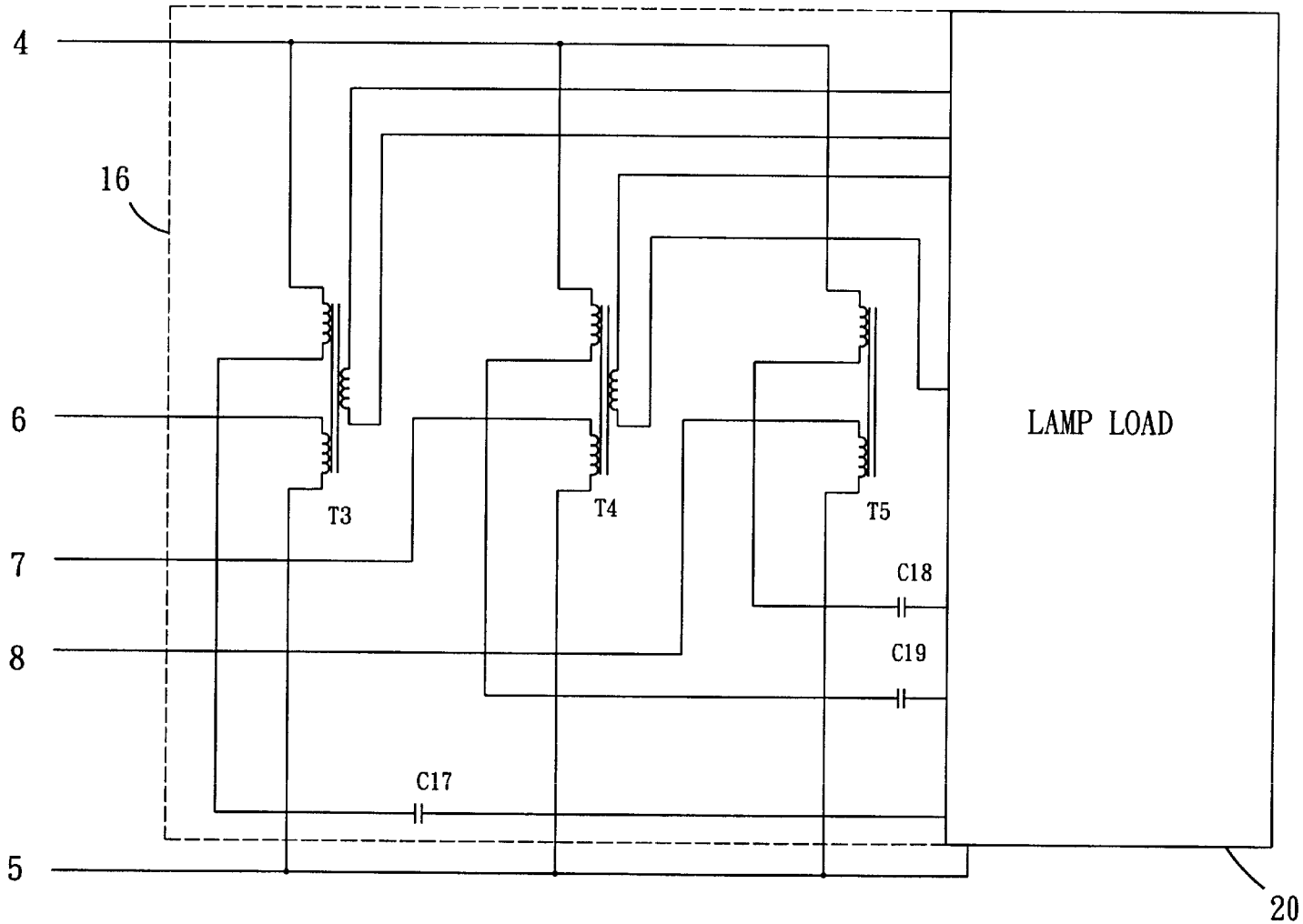
FIG. 4 is a schematic electrical circuit diagram showing a phase correction unit of the preferred embodiment.

Referring to FIG. 4, the phase correction unit 16 is connected to the converter circuit 144 of the frequency inverter unit 14 at node 4, and is adapted to be connected to a lamp load 20. In this embodiment, the phase correction unit 16 includes three sets of a transformer T3, T4, T5 and a capacitor C17, C18, C19 that are connected in series. The transformers T3, T4, T5 of the phase correction unit 16 perform phase correction upon the high voltage, high frequency AC output from the converter circuit 144 for driving the lamp load 20 to operate.

By virtue of the frequency inverter unit 14, the supply of a stable operating current to the lamp load 20 can be ensured for driving the latter to operate even under the presence of input power fluctuations.

Referring once again to FIGS. 3 and 4, the over-voltage protection circuit 18 is connected to the phase correction unit 16 at nodes 5, 6, 7 and 8, and includes a diode set 180 that cooperates with a zener diode Z4 to form a detector circuit, and a bypass circuit 182 connected to the detector circuit. Node 5 is connected to a ground node 3 of the voltage multiplying unit 12. The diode set 180 includes three diodes D13, D14, D15 connected to the transformers T3, T4, T5 of the phase correction unit 16 at the nodes 6, 7, 8, respectively. The bypass circuit 182 includes a thyristor SCR1. The diodes D13, D14, D15 are connected to the zener diode Z4 via a resistor R27, and are connected to the transformer T2 via a resistor R29. The thyristor SCR1 has a gate connected to the zener diode Z4 via a resistor R24, and is further connected across a node 2 of the voltage multiplying unit 12 and the ground node 3. A resistor R26 interconnects the resistor R27 and the ground node 3.

During normal operating conditions, the zener diode Z4 is in a non-conducting state, and the voltage at the gate of the thyristor SCR1 is insufficient to cause the latter to conduct. However, in the event of an over-voltage condition at the phase correction unit 16, the voltage across the zener diode Z4 will exceed the zener breakdown voltage, thereby causing the latter to conduct. At this time, the voltage at the gate of the thyristor SCR1 will be sufficient to trigger conduction of the same. Because the thyristor SCR1 is connected to the driver circuit 140 of the frequency inverter unit 14 via a diode D10, to the pulse-width modulator 120 of the voltage multiplying unit 12 at node 2, and to the ground node 3, conduction of the thyristor SCR1 will result in grounding of a power input terminal of the driver circuit 140 and the pulse-width modulator 120. As a result, both the frequency inverter unit 14 and the voltage multiplying unit 12 are inhibited from operation such that the lamp ballast system of this invention is prevented from supplying abnormal operating currents to the lamp load 20. Damage to the lamp load 20 and electrical components of the lamp ballast system of this invention due to abnormal operating conditions can thus be avoided.

In the preferred embodiment, an adjustment unit 19 is connected to the driver circuit 140, and includes a transistor Q1 connected across a variable resistor VR1. By varying the resistance of the variable resistor VR1, the frequency of the pulse-width modulated output of the driver circuit 140 can be adjusted to adjust in turn the frequency of the oscillating current output from the push-pull oscillator circuit 142 to correspond with the characteristics of the lamp load 20 and for energy-saving purposes.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A lamp ballast system adapted to be connected to a lamp load, comprising:

a rectifying and filtering unit adapted to rectify and filter an alternating current input so as to generate a direct current output;

a voltage multiplying unit connected to said rectifying and filtering unit so as to receive the direct current output therefrom, said voltage multiplying unit being operable so as to generate a voltage-multiplied direct current output;

a frequency inverter unit including a driver circuit connected to said voltage multiplying unit so as to receive the voltage-multiplied direct current output therefrom, an oscillator circuit connected to and driven by said driver circuit so as to generate a high-frequency oscillating current output, and a converter circuit connected to said oscillator circuit so as to receive the high-frequency oscillating current output, and operable so as to convert the oscillating current output into a stable high voltage, high frequency alternating current output; and a phase correction unit adapted to interconnect said converter circuit and the lamp load, and including at least one set of a transformer and a capacitor that are connected in series.

2. The lamp ballast system of claim 1, wherein said driver circuit includes a pulse-width modulator that provides a pulse-width modulated output to said oscillator circuit, said lamp ballast system further comprising an adjustment unit connected to said pulse-width modulator and operable so as to adjust frequency of the pulse-width modulated output to adjust in turn frequency of the oscillating current output from said oscillator circuit.

3. The lamp ballast system of claim 1, wherein:

said oscillator circuit includes a push-pull oscillator circuit, and a coupling capacitor connected to said push-pull oscillator circuit;

said converter circuit including a step-up transformer connected to said coupling capacitor, and a pair of half-wave switching transistor circuits connected to and driven by said step-up transformer so as to generate the alternating current output.

4. The lamp ballast system of claim 1, further comprising an over-voltage protection unit connected to said phase correction unit, said voltage multiplying unit and said driver circuit, said over-voltage protection unit inhibiting operation of said voltage multiplying unit and said driver circuit upon detection of an over-voltage condition at said phase correction unit.

5. The lamp ballast system of claim 4, wherein said over-voltage protection unit includes a bypass circuit having a thyristor that is coupled to said voltage multiplying unit, said driver circuit, and a ground node, and a detector circuit connected to said thyristor and said phase correction unit, said detector circuit causing said thyristor to conduct, thereby connecting said voltage multiplying unit and said driver circuit to said ground node, upon detection of the over-voltage condition at said phase correction unit.

* * * * *